US006298686B1

(12) United States Patent
Moore

(10) Patent No.: US 6,298,686 B1
(45) Date of Patent: Oct. 9, 2001

(54) MULTI-STAGE INDEXING COOLER

(75) Inventor: Geoffrey H. Moore, Sarnia (CA)

(73) Assignee: Fibrex Insulations, Inc., Ontario (CA)

( * ) Notice: Subject to any disclaimer, the term of this patent is extended or adjusted under 35 U.S.C. 154(b) by 0 days.

(21) Appl. No.: 09/610,852

(22) Filed: Jul. 5, 2000

(51) Int. Cl.[7] ..... F25D 25/04; F25D 13/06; F25D 23/12

(52) U.S. Cl. ..... 62/380; 62/63; 62/65; 62/331

(58) Field of Search ..... 62/378, 380, 62, 62/63, 65, 371

(56) References Cited

U.S. PATENT DOCUMENTS

| | | | | |
|---|---|---|---|---|
| 1,513,881 | | 11/1924 | Ayres . | |
| 2,157,131 | | 5/1939 | Hothersall et al. . | |
| 2,275,588 | | 3/1942 | Greene . | |
| 2,901,891 | * | 9/1959 | Morrison | 62/380 |
| 3,267,585 | * | 8/1966 | Futer | 62/380 |
| 3,442,029 | | 5/1969 | Adair . | |
| 3,455,120 | * | 7/1969 | Schlemmer | 62/380 |
| 4,173,079 | | 11/1979 | Cruff et al. . | |
| 4,345,443 | * | 8/1982 | Yamashita | 62/380 |
| 4,414,758 | | 11/1983 | Peter et al. . | |
| 4,663,860 | | 5/1987 | Beall . | |
| 4,697,354 | | 10/1987 | Gottschalk . | |
| 5,070,624 | | 12/1991 | Vero et al. . | |
| 5,816,067 | * | 10/1998 | Cloarec | 62/374 |

* cited by examiner

*Primary Examiner*—William Doerrler
(74) *Attorney, Agent, or Firm*—Dinesh Agarwal, P.C.

(57) ABSTRACT

An apparatus for cooling an insulation product. The apparatus includes an in-line series of cooling stations, transport means, and cooling fluids supply means. The in-line series of cooling stations includes a first cooling station for receiving the insulation product into the in-line series of cooling stations, and a last cooling station for discharging the cooled insulation product from the in-line series of cooling stations. Each cooling station in the series of cooling stations except for the first cooling station has an associated previous cooling station. Each cooling station in the series of cooling stations except for the last cooling station has an associated next cooling station. The transfer means is for moving the insulation product through each station in the series of stations. For each cooling station in the series of cooling stations except for the first cooling station, the transport means is operable to move the insulation product into the cooling station from the associated previous cooling station. For each cooling station in the series of cooling stations except for the last cooling station, the transport means is operable to move the insulation product from the cooling station to the associated next cooling station. The cooling fluids supply means is operable to supply cooling fluid to each station in the series of stations to cool the insulation product.

47 Claims, 5 Drawing Sheets

Figure 1:
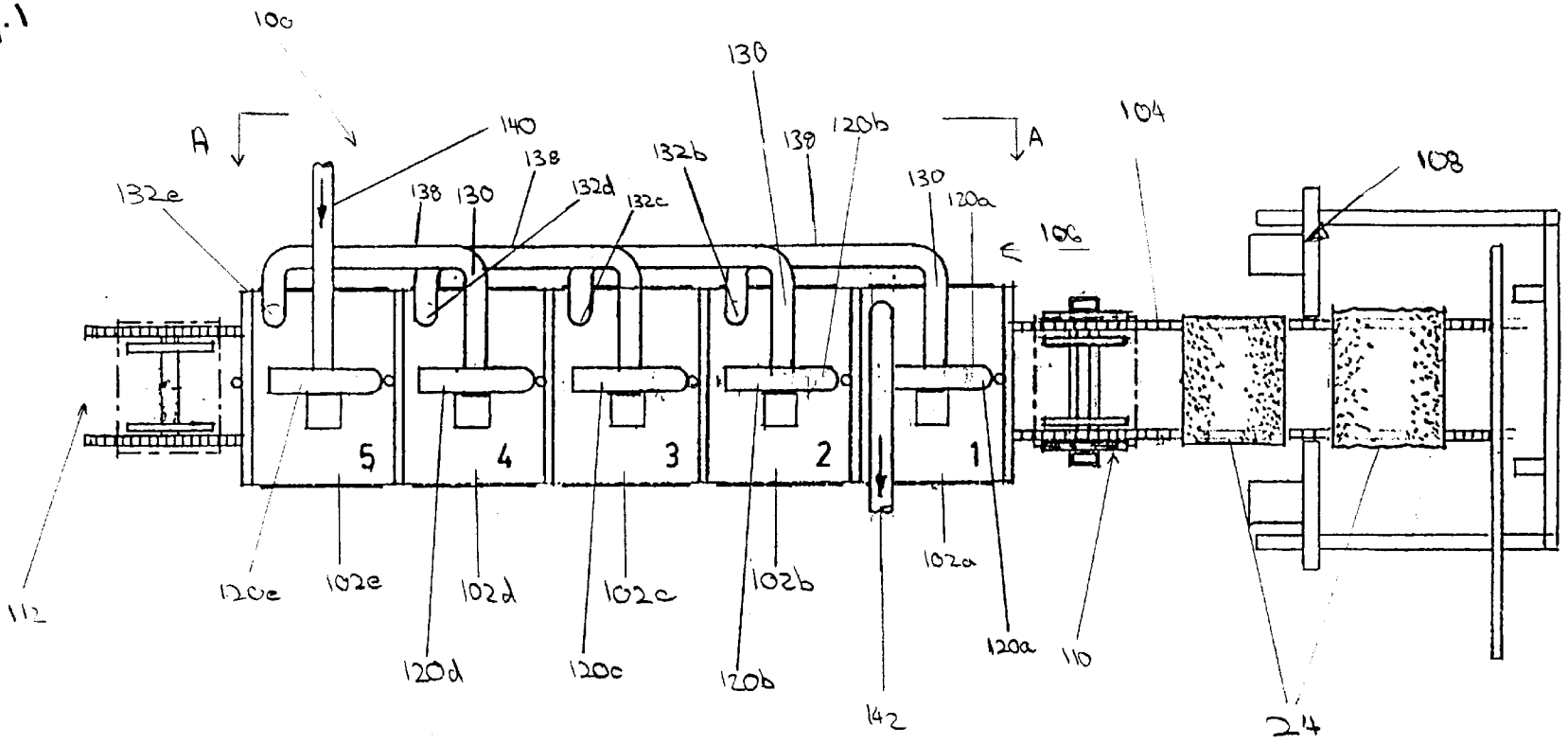

148
150
146
150
150
116

MULTI-STAGE INDEXING COOLER

FIELD OF THE INVENTION

This invention relates in general to a cooling apparatus, and more particularly to a multi-stage indexing cooler for cooling pipe insulation.

BACKGROUND OF THE INVENTION

Fibrous insulation is composed of many fine fibres that give the fibrous insulation a very large surface area relative to the volume it occupies. Each fibre traps a boundary layer of air, thereby providing the insulation function of the fibrous insulation. Rigid fibre insulations are typically set or cured by applying heat to a thermoset resin that binds the fibres into a rigid matrix. Heat is applied using high velocity heated air. Once cured or set, the insulation must be cooled. This requires a cooling fluid flow to be directed through the insulation, and can take a considerable amount of time.

Prior art cooling units have been devised to cool fibrous insulation. Generally, such cooling units include a high power fan that blows cooling air through the fibrous insulation at a high velocity. This high velocity cooling air is subsequently filtered by a filter system and then discharged into the atmosphere. Filtering is required as the cooling process strips not only the entrapped air and heat from the insulation, but also the smokes and fumes and other pollutants produced as a result of the high temperature curing of the thermoset resin.

Prior cooling units are often energy inefficient, and may also constitute a significant source of environmental pollution. Specifically, a lot of energy is consumed in producing high velocity air. Much of the energy required to impart this velocity to the air is lost, as the high velocity air is eventually discharged into the atmosphere after being blown through the fibrous insulation. Discharging heated high velocity air into the atmosphere also wastes the heat energy that has been stripped from the insulation product, and is, in addition, environmentally problematic, as pollutants from the insulation product may be discharged into the atmosphere.

Accordingly, a cooling unit that reduces the velocity requirements of the cooling fluid used to cool the insulation product, and that recovers heat from the cooling fluid after cooling, is desirable from an energy conservation perspective. From an environmental perspective, an improved cooling unit that facilitates the removal of pollutants before the cooling fluid is discharged into the atmosphere is also desirable.

SUMMARY OF THE INVENTION

An object of an aspect of the present invention is to provide an improved cooling apparatus.

In accordance with an aspect of the present invention there is provided an apparatus for cooling an insulation product. The apparatus includes an in-line series of cooling stations, transport means, and cooling fluids supply means. The in-line series of cooling stations includes a first cooling station for receiving the insulation product into the in-line series of cooling stations, and a last cooling station for discharging the cooled insulation product from the in-line series of cooling stations. Each cooling station in the series of cooling stations except for the first cooling station has an associated previous cooling station. Each cooling station in the series of cooling stations except for the last cooling station has an associated next cooling station. The transfer means is for moving the insulation product through each station in the series of stations. For each cooling station in the series of cooling stations except for the first cooling station, the transport means is operable to move the insulation product into the cooling station from the associated previous cooling station. For each cooling station in the series of cooling stations except for the last cooling station, the transport means is operable to move the insulation product from the cooling station to the associated next cooling station. The cooling fluids supply means is operable to supply cooling fluid to each station in the series of stations to cool the insulation product.

Conveniently, the apparatus further comprises station connection control means for selectably connecting and disconnecting different station in the series of stations.

Preferably, the fluid supply means comprises fluid connection means for directing fluid through the series of cooling stations. The fluid connection means is operable to direct cooling fluid into the last cooling station, and then from each cooling station, except for the first cooling station, into the associated previous cooling station, and into each station, except for the last cooling station, from the associated next cooling station, and finally, from the first cooling station into a hot fluid receiving means.

In accordance with a second aspect of the present invention there is provided an apparatus for cooling an insulation product and for heating a fluid supplied to the insulation product. The apparatus includes a first end, a second end opposite to the first end, a transport means for moving the insulation product through the apparatus in a first direction from the first end to the second end, a fluid supply means for supplying fluid to the insulation product and for moving the fluid in a second direction through the apparatus from the second end to the first end; and a fluid receiving means for receiving heated fluid from the first end of the apparatus.

A BRIEF DESCRIPTION OF THE DRAWINGS

Figure 2:
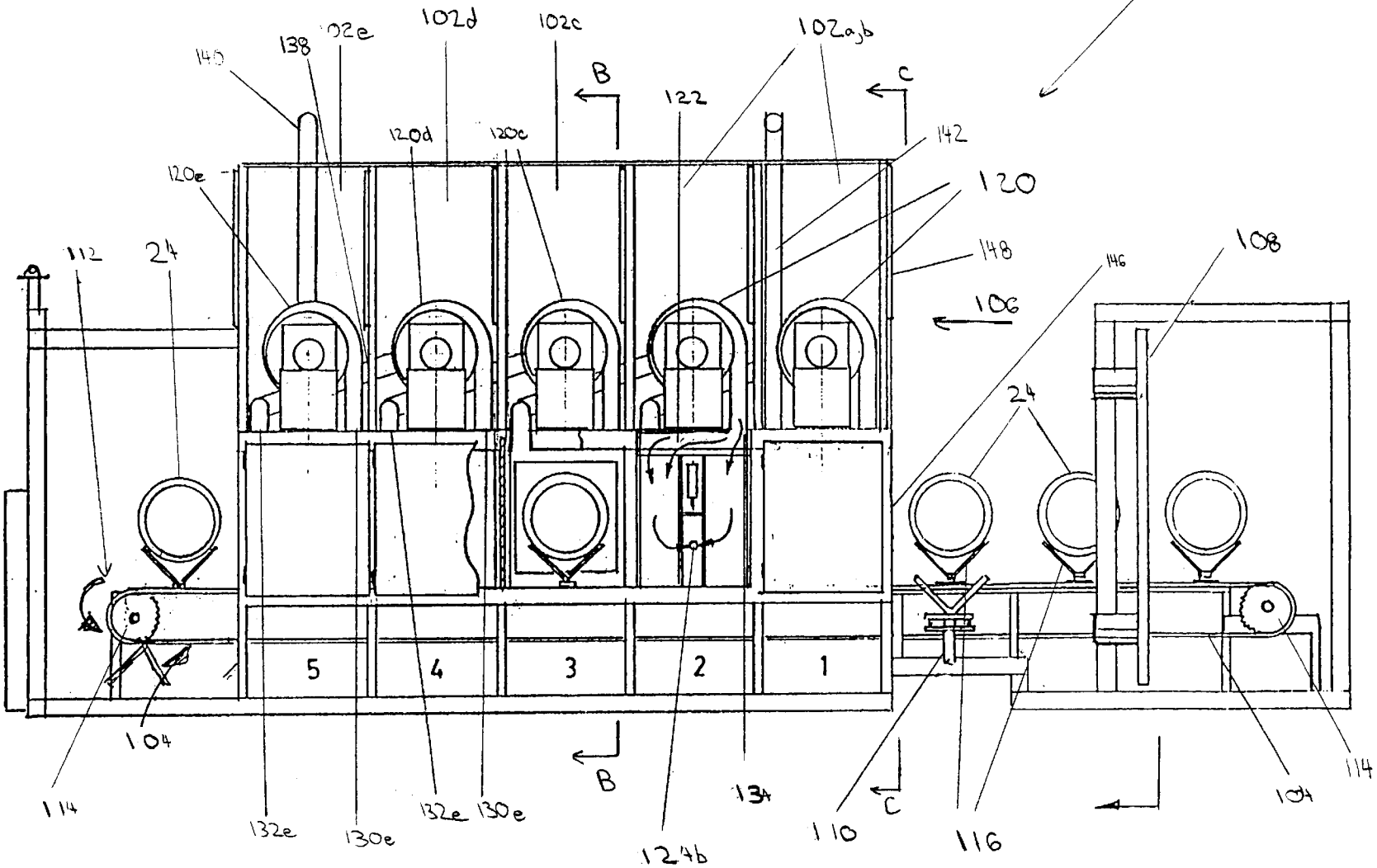
Figure 3:
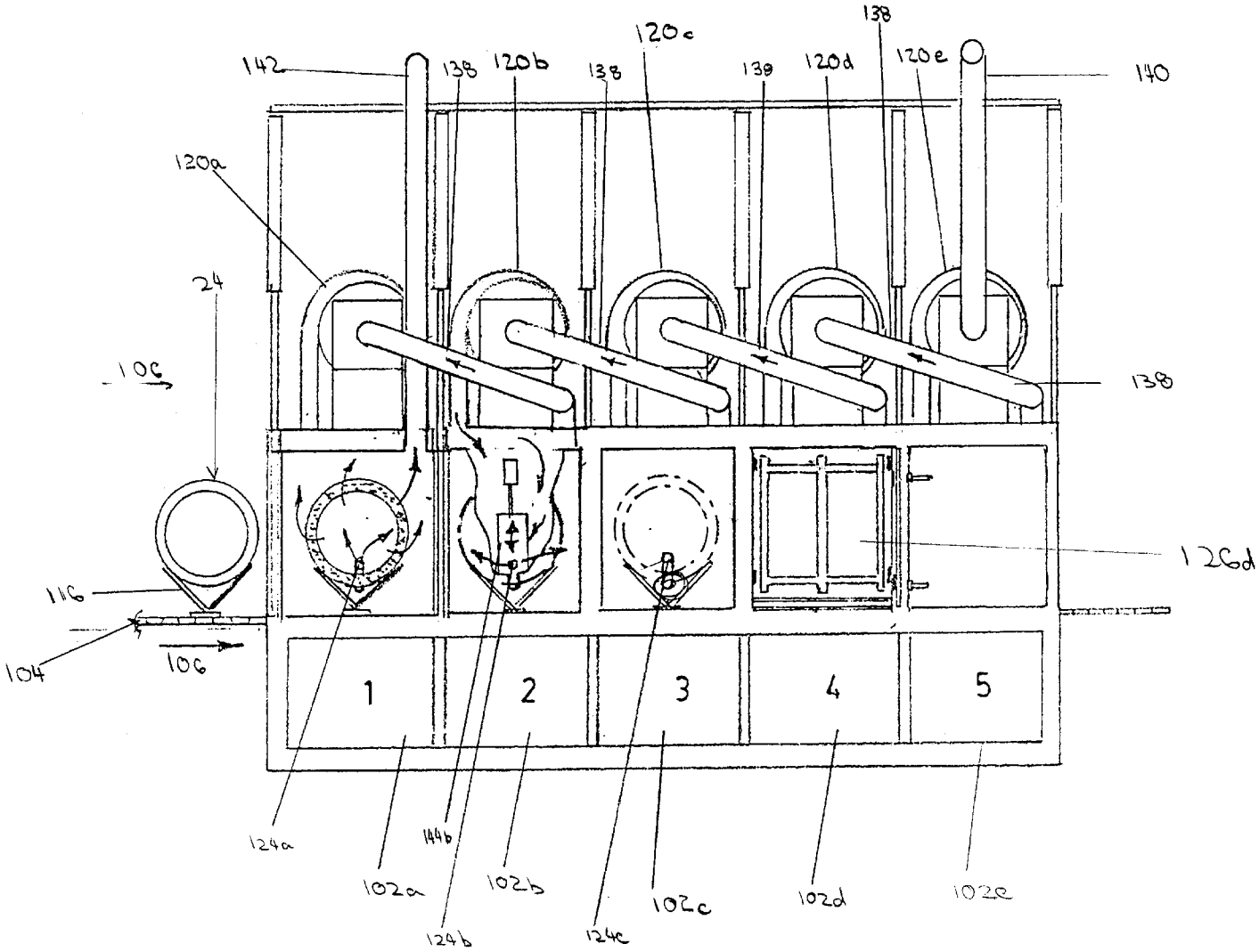
Figure 4:
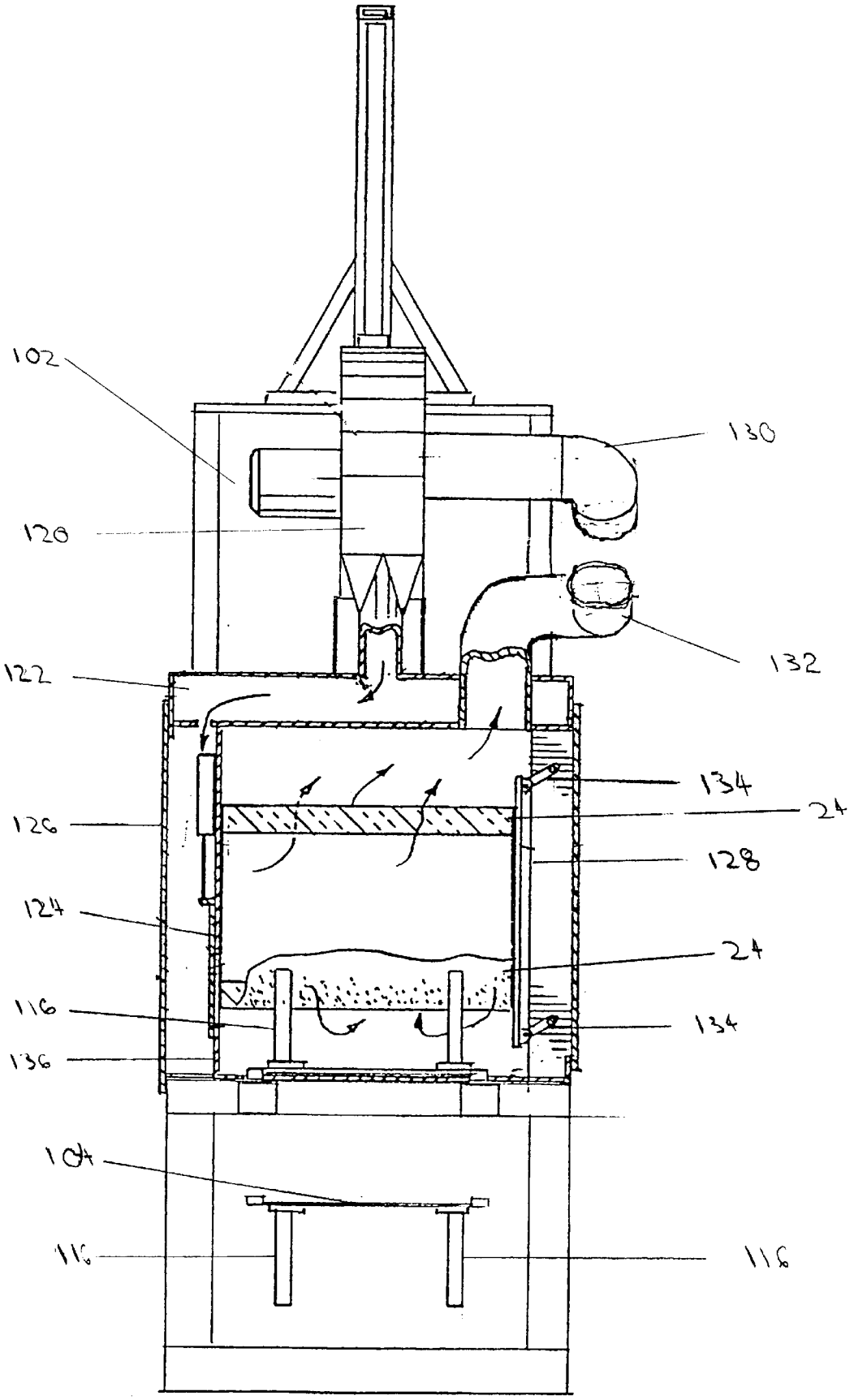
Figure 5:
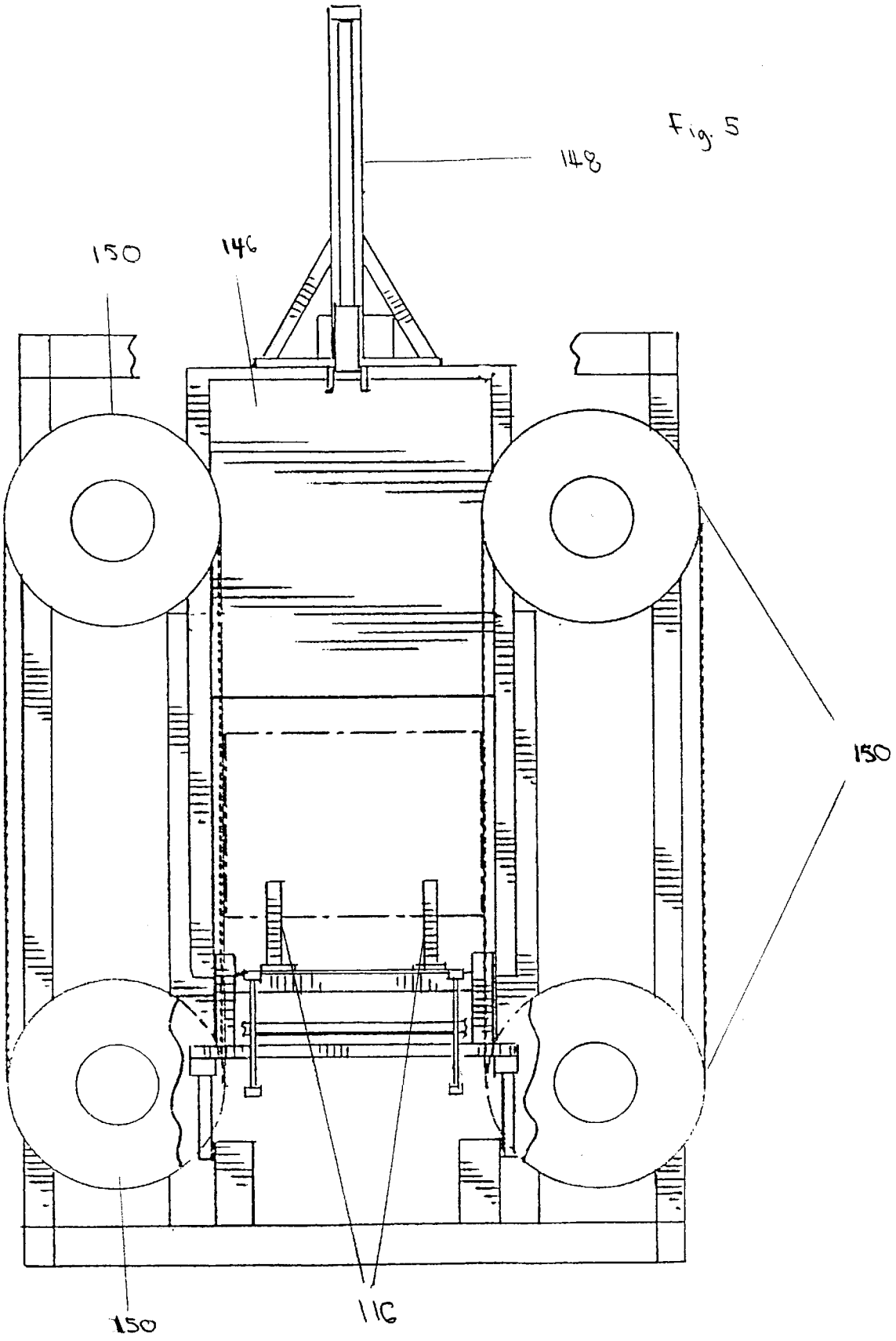

A detailed description of the preferred embodiments of the invention is provided herein below with reference to the following drawings, in which:

FIG. 1, in a plan view, illustrates a cooling apparatus in accordance with a preferred embodiment of the present invention;

FIG. 2, in a side view, illustrates the cooling apparatus of FIG. 1;

FIG. 3, in a side view in the direction of the arrows marked A—A in FIG. 1 and within the limits defined by those arrows, illustrates the cooling apparatus of FIG. 1;

FIG. 4, in a cut-away side view in the direction of the arrows marked B—B of FIG. 2 and within the limits defined by those arrows, illustrates an individual cooling station of the cooling apparatus of FIG. 1; and, FIG. 5, in a side view in the direction of the arrows marked C—C in FIG. 2, illustrates a sealing door of the cooling apparatus of FIG. 1.

DETAILED DESCRIPTION OF THE PREFERRED EMBODIMENTS OF THE INVENTION

Referring to FIG. 1, there is illustrated in a plan view, a cooling apparatus in accordance with the preferred embodiment of the present invention. The cooling apparatus 100 includes five individual in-line cooling stations 102. In operation, insulation product 24 is cut at an end-cut station 108 to a pre-determined length. The cut insulation product 24 can then be weighed at a weighing station 110 before being transported by indexing conveyor 104, which carries the insulation product 24 in the direction designated 106 in FIG. 1, into the in-line cooling station 102*a*. The weight of the insulation product 24 can then be used to provide feedback regarding the product. Weighing the insulation product prior to cooling permits any adjustments suggested by the weight measured to be made sooner, as the delay necessitated by waiting for the insulation product to proceed through the 5 cooling stations 102 is avoided. If, for example, the insulation product is heavier than expected, then more cooling will be required and the fan speed may be increased or the cooling time extended accordingly.

Once within in-line cooling stations 102, the insulation product 24 is progressively cooled in each of the cooling stations 102 moving in direction 106, and is ultimately discharged at discharge end 112. Specifically, cooling air is first supplied to the cooling station 102*e,* via a cold air inlet 140. The cold air inlet 140 supplies the cooling air to a fan 120*e* that blows the cooling air against the insulation product within the cooling station 102*e*. Afterwards, having passed through the wall of the insulation product 24 in a radial direction, the slightly heated cooling air exits cooling station 102*e* via station outlet 132*e*. From there the cooling air passes through an interstation conduit 138 to a station inlet 130 for the cooling station 102*d* adjacent to the cooling station 102*e*. The cooling air passes through each of the in-line cooling stations 102 of FIG. 1, moving from left to right in FIG. 1, while the insulation product 24 moves in the opposite direction, from right to left in FIG. 1, through each of the cooling stations 102. At the cooling station 102*a,* the cooling air has passed through, and has been heated in, all of the other cooling stations 102. After being applied to the insulation product 24 in cooling station 102*a,* the cooling air is discharged from the cooler unit 100 via a hot air outlet conduit 142.

Preferably, the heated cooling air from hot air outlet conduit 142 is directed to an incinerator for further heating and to incinerate smokes and particulates, before being used to cure the insulation product 24 upstream of the cooler unit 100. Effectively, the cooler unit 100 with the in-line cooling stations 102 provide a reverse flow heat transfer process in which the insulation product 24 acts as a media for heating the cooling air.

Referring to FIG. 2, there is illustrated a side view of the cooler unit 100 of FIG. 1. As shown in FIG. 1, the cooler unit 100 comprises an in-line series of cooling stations 102. Cooling air is supplied to the end cooling station marked "5" by the cold air inlet 140. The cooling air is blown into the cooling station 102*e* and against the insulation product 24 through station inlet 130*e* by the fan 120*e*. Then, the cooling air exits the cooling station 102*e* via station outlet 132*e* and proceeds to fan 120*d* of cooling station 102*d* adjacent to cooling station 102*e* via interstation conduit 138. As shown in FIG. 2, the insulation product 24 is supported on "V" supports 116. The "V" supports 116 are themselves supported on an indexing conveyor 104 that moves the insulation product 24 in direction 106 through the cooler unit 100. The indexing conveyor 104 can be started and stopped to transport the insulation product 24 to each cooling station 102, and to stop the insulation product 24 in each cooling station 102. Referring to FIG. 3, there is shown a side view of the in-line sequential cooling stations in the direction of the arrows marked A—A in FIG. 1 and within the limits defined by those arrows. This side view is opposite to the side view of FIG. 2. Accordingly, in this side view, the insulation product 24 proceeds through the cooling stations 102 from left to right.

Referring to FIG. 4, there is illustrated, in a sectional view in the direction of the arrows marked B—B in FIG. 2, an in-line cooling station 102. The insulation product 24 is supported by "V" supports 116 mounted on the indexing conveyor 104. It is this "V" support 116 that supports the insulation product from the end-cut station 108 to the weighing station 110 and from thence through the in-line cooling stations 102 to the discharge end 112. In FIG. 4, the insulation product 24 is shown being gripped between a seal plate 128 and an opposing plate 136. The seal plate 128 is mounted on parallel links 134 that are pivotable to pivot the seal plate 128 into sealing engagement with the insulation product 24, and out of sealing engagement to release the insulation product 24 so that it can be moved by the indexing conveyor 104.

The cooling air is blown by the fan 120 into a top plenum 122. From there the pressure generated in the top plenum 122 by the fan 120 forces the cooling air down to valve 124 through which the cooling air is forced into the interior of the insulation product 24. The positive air pressure generated within the insulation product 24 by the fan 120 forces cooling air through the insulation product 24 to cool the insulation product 24. From there, the cooling air is forced through the station outlet 132 for the cooling station 102. Further detail regarding the valve is shown in FIG. 3.

Referring back to FIG. 3, the cooling zone 102*d* is shown with the seal plate 128 closed (a rear access door has been removed to reveal the seal plate 128 and support frame). The sealed front access doors 126 (not shown in FIG. 3), one for each of the cooling stations 102, permits access to the cooling station for maintenance. When a front access door 126 for a cooling station 102 is closed, the front access door 126 forms a duct through which cooling air can flow from the top plenum 122 to the valve 124. In cooling zone 102*c* of FIG. 3, the insulation product 24 is shown on a "V" support 116 and the inlet valve 124*c* for cooling station 102*c* is shown in relation to a typical large piece of insulation product 24. As shown, the valve 124 has an oval slot, which may be closed off completely to interrupt the airflow through the valve 124 when the insulation product 24 is being indexed from one cooling station to another. As shown in cooling station 102*b* of FIG. 3, the valve 124*b* is opened and closed by a suitable valve plate 144. The valve plate 144, in addition to closing the valve 124 completely, can also be varied in stroke to ensure that the circular opening of the valve 124 is always located within the hollow defined by the insulation product 24. Usually, the centre of a small diameter insulation product will sit lower on the "V" support 116 on the indexing conveyor. Accordingly, to ensure that an adequate supply of cooling air is provided to the interior of a small insulation product 24, the valve 124 should be opened further. In contrast, when the insulation product is relatively large, the valve stroke of the valve plate 144 should be reduced to keep the cooling airflow inside the insulation product 24.

Referring to FIG. 5, there is illustrated in a side view, a station door 146 that is operable to close and thereby seal an individual cooling station 102 from other cooling stations 102 and from the external environment, and is also operable to open to permit indexing of the insulation product 24 between cooling stations 102. These six cooling station doors 146 are opened and closed by a fast-acting air cylinder 148, and are guided by door-guide wheels 150. Before the indexing conveyor 104 indexes the insulation 24, the station doors 146 are raised. As soon as indexing is complete, the station doors are lowered. In this way, the cooling air in each cooling station 102 is discharged into the previous cooling station 102 only, and is neither allowed to migrate through the in-line cooling stations in the opposite direction nor released into other areas of the factory.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An apparatus for cooling an insulation product and for heating a fluid supplied to the insulation product, the apparatus comprising:

a first end;

a second end opposite to the first end;

a transport means for moving the insulation product through the apparatus in a first direction from the first end to the second end;

fluid supply means for supplying fluid to the insulation product and for moving the fluid in a second direction through the apparatus from the second end to the first end; and, fluid receiving means for receiving heated fluid from the first end of the apparatus, said fluid receiving means comprising an incinerator for further heating the fluid and for incinerating pollutants discharged from the insulation product.

2. The apparatus as defined in claim 1 comprising fluid flow control means for impeding movement of the fluid in the first direction.

3. The apparatus as defined in claim 2 wherein the fluid flow control means comprises a series of doors spaced from the first end to the second end, the doors being openable to move the insulation product in the first direction, and closeable to impede fluid flow in the first direction.

4. An apparatus for cooling an insulation product, the apparatus comprising:

(a) an in-line series of cooling stations for cooling the insulation product, the series of cooling stations having a first cooling station for receiving the insulation product into the in-line series of cooling stations and a last cooling station for discharging the cooled insulation product from the in-line series of cooling stations;

(i) each cooling station in the series of cooling stations except for the first cooling station having an associated previous cooling station, and (ii) each cooling station in the series of cooling stations except for the last cooling station having an associated next cooling station;

(b) transport means for moving the insulation product through each station in the series of cooling stations, the transport means being operable to, (i) for each cooling station in the series of cooling stations except for the first cooling station, to move the insulation product into the cooling station from the associated previous cooling station, and (ii) for each cooling station in the series of cooling stations except for the last cooling station, to move the insulation product from the cooling station to the associated next cooling station;

(c) cooling fluid supply means for supplying cooling fluid to each station in the series of stations to cool the insulation product; and (d) a weigh section for weighing the insulation product before cooling.

5. The apparatus as defined in claim 4, further comprising:

station connection control means for connecting stations in the series of stations, wherein the station connection control means is operable to for each cooling station in the series of cooling stations except for the first cooling station, to connect the cooling station with the associated previous cooling station, and for each cooling station in the series of cooling stations except for the last cooling station, to connect the cooling station to the associated next cooling station.

6. The apparatus as defined in claim 5, wherein:

the in-line series of cooling stations comprises an external housing for containing each station in the in-line series of stations, and the transport means is operable to move the insulation product through each station in the in-line series of stations without removing the insulation product from the housing.

7. The apparatus as defined in claim 6, wherein:

each cooling station in the series of cooling stations having an associated previous cooling station is adjacent to the associated previous cooling station, each cooling station in the series of cooling stations having an associated next cooling station is adjacent to the associated next cooling station, and for each cooling station in the series of stations except for the last station, the station connection control means comprises an associated exit door for controllably separating the station from the associated next cooling station, and associated door control means for opening the associated exit door to connect the station with the associated next cooling station, and for closing the associated exit door to substantially seal the station from the associated next cooling station.

8. The apparatus as defined in claim 7, further comprising:

an external entrance door for the first cooling station, an external exit door for the last cooling station, and external door control means for opening and closing the external entrance door and the external exit door.

9. The apparatus as defined in claim 5, wherein the cooling fluid supply means comprises:

(a) fluid connection means for directing fluid through the series of cooling stations, the fluid connections means being operable to direct cooling fluid (i) into the last cooling station, and then (ii) from each cooling station, except for the first cooling station, into the associated previous cooling station, (iii) into each cooling station, except for the last cooling station, from the associated next cooling station, and finally (iv) from the first cooling station into a hot fluid receiving means.

10. The apparatus as defined in claim 9, wherein the fluid connection means comprises an associated valve for each station in the in-line series of cooling stations for directing the cooling fluid at the insulation product within the cooling station.

11. The apparatus as defined in claim 9, wherein the fluid connection means includes a valve control means for opening and closing the associated valve for each cooling station in the in-line series of cooling stations.

12. The apparatus as defined in claim 10, wherein:

the insulation product is hollow and has two open ends;

each cooling station in the in-line series of cooling stations comprises a pair of sealing plates for sealing each open end of the insulation product; and, the associated valve for each cooling station in the in-line series of cooling stations is operable to direct cooling fluid into a hollow interior of the insulation product.

13. The apparatus as defined in claim 12, wherein the fluid connection means comprises, for each station in the in-line series of cooling stations, an associated fluid outlet for receiving the cooling fluid from outside the insulation product and from within the cooling station.

14. The apparatus as defined in claim 13, wherein:

the cooling fluid is released into the last cooling station by the associated valve for the last cooling station;

for each cooling station in the series of cooling stations except for the last cooling station, the associated valve receives the cooling fluid from the associated fluid outlet for the associated next cooling station, and for the first cooling station, the heated cooling fluid received into the associated fluid outlet is directed to the hot fluid receiving means.

15. The apparatus as defined in claim 10, wherein each valve has an associated fan for blowing cooling fluid through the valve.

16. The apparatus as defined in claim 15, wherein a speed of the fan is adjustable to control at least one of a cooling rate and a hot fluid exhaust temperature.

17. The apparatus as defined in claim 10, wherein each valve is adjustable to accommodate insulation product of different dimensions.

18. The apparatus as defined in claim 9, wherein the hot fluid receiving means includes an incinerator for further heating the cooling fluid and for incinerating pollutants discharged from the insulation product during cooling.

19. The apparatus as defined in claim 4, wherein the transport means is a conveyor belt.

20. The apparatus as defined in claim 4, further comprising a cutting section for cutting the insulation product before cooling.

21. An apparatus for cooling an insulation product, the apparatus comprising:

(a) an in-line series of cooling stations for cooling the insulation product, the series of cooling stations having a first cooling station for receiving the insulation product into the in-line series of cooling stations and a last cooling station for discharging the cooled insulation product from the in-line series of cooling stations;

(i) each cooling station in the series of cooling stations except for the first cooling station having an associated previous cooling station, and (ii) each cooling station in the series of cooling stations except for the last cooling station having an associated next cooling station;

(b) transport means for moving the insulation product through each station in the series of cooling stations, the transport means being operable to, (i) for each cooling station in the series of cooling stations except for the first cooling station, to move the insulation product into the cooling station from the associated previous cooling station, and (ii) for each cooling station in the series of cooling stations except for the last cooling station, to move the insulation product from the cooling station to the associated next cooling station;

(c) cooling fluid supply means for supplying cooling fluid to each station in the series of stations to cool the insulation product; and (d) a cutting section for cutting the insulation product before cooling.

22. An apparatus for cooling an insulation product, the apparatus comprising:

(a) an in-line series of cooling stations for cooling the insulation product, the series of cooling stations having a first cooling station for receiving the insulation product into the in-line series of cooling stations and a last cooling station for discharging the cooled insulation product from the in-line series of cooling stations;

(i) each cooling station in the series of cooling stations except for the first cooling station having an associated previous cooling station, and (ii) each cooling station in the series of cooling stations except for the last cooling station having an associated next cooling station;

(b) transport means for moving the insulation product through each station in the series of cooling stations, the transport means being operable to, (i) for each cooling station in the series of cooling stations except for the first cooling station, to move the insulation product into the cooling station from the associated previous cooling station, and (ii) for each cooling station in the series of cooling stations except for the last cooling station, to move the insulation product from the cooling station to the associated next cooling station;

(c) cooling fluid supply means for supplying cooling fluid to each station in the series of stations to cool the insulation product;

(d) station connection control means for connecting stations in the series of stations, wherein the station connection control means is operable to for each cooling station in the series of cooling stations except for the first cooling station, to connect the cooling station with the associated previous cooling station, and for each cooling station in the series of cooling stations except for the last cooling station, to connect the cooling station to the associated next cooling station;

(e) an external entrance door for the first cooling station;

(f) an external exit door for the last cooling station; and (g) external door control means for opening and closing the external entrance door and the external exit door;

wherein the in-line series of cooling stations comprises an external housing for containing each station in the in-line series of stations, and the transport means is operable to move the insulation product through each station in the in-line series of stations without removing the insulation product from the housing; and wherein each cooling station in the series of cooling stations having an associated previous cooling station is adjacent to the associated previous cooling station, each cooling station in the series of cooling stations having an associated next cooling station is adjacent to the associated next cooling station, and for each cooling station in the series of stations except for the last station, the station connection control means comprises an associated exit door for controllably separating the station from the associated next cooling station, and associated door control means for opening the associated exit door to connect the station with the associated next cooling station, and for closing the associated exit door to substantially seal the station from the associated next cooling station.

23. An apparatus for cooling an insulation product, the apparatus comprising:

(a) an in-line series of cooling stations for cooling the insulation product, the series of cooling stations having a first cooling station for receiving the insulation product into the in-line series of cooling stations and a last cooling station for discharging the cooled insulation product from the in-line series of cooling stations;

(i) each cooling station in the series of cooling stations except for the first cooling station having an associated previous cooling station, and (ii) each cooling station in the series of cooling stations except for the last cooling station having an associated next cooling station;

(b) transport means for moving the insulation product through each station in the series of cooling stations, the transport means being operable to, (i) for each cooling station in the series of cooling stations except for the first cooling station, to move the insulation product into the cooling station from the associated previous cooling station, and (ii) for each cooling station in the series of cooling stations except for the last cooling station, to move the insulation product from the cooling station to the associated next cooling station; and, (c) cooling fluid supply means for supplying cooling fluid to each station in the series of stations to cool the insulation product;

(d) station connection control means for connecting stations in the series of stations;

wherein the cooling fluid supply means comprises (A) fluid connection means for directing fluid through the series of cooling stations, the fluid connections means being operable to direct cooling fluid (i) into the last cooling station, and then (ii) from each cooling station, except for the first cooling station, into the associated previous cooling station, (iii) into each cooling station, except for the last cooling station, from the associated next cooling station, and finally (iv) from the first cooling station into a hot fluid receiving means;

wherein the fluid connection means comprises an associated valve for each station in the in-line series of cooling stations for directing the cooling fluid at the insulation product within the cooling station; and wherein the insulation product is hollow and has two open ends; each cooling station in the in-line series of cooling stations comprises a pair of sealing plates for sealing each open end of the insulation product; and the associated valve for each cooling station in the in-line series of cooling stations is operable to direct cooling fluid into a hollow interior of the insulation product.

24. The apparatus as defined in claim 23, wherein the station connection control means is operable to for each cooling station in the series of cooling stations except for the first cooling station, to connect the cooling station with the associated previous cooling station, and for each cooling station in the series of cooling stations except for the last cooling station, to connect the cooling station to the associated next cooling station.

25. The apparatus as defined in claim 24, wherein:

the in-line series of cooling stations comprises an external housing for containing each station in the in-line series of stations, and the transport means is operable to move the insulation product through each station in the in-line series of stations without removing the insulation product from the housing.

26. The apparatus as defined in claim 25, wherein:

each cooling station in the series of cooling stations having an associated previous cooling station is adjacent to the associated previous cooling station, each cooling station in the series of cooling stations having an associated next cooling station is adjacent to the associated next cooling station, and for each cooling station in the series of stations except for the last station, the station connection control means comprises an associated exit door for controllably separating the station from the associated next cooling station, and associated door control means for opening the associated exit door to connect the station with the associated next cooling station, and for closing the associated exit door to substantially seal the station from the associated next cooling station.

27. The apparatus as defined in claim 26, further comprising:

an external entrance door for the first cooling station, an external exit door for the last cooling station, and external door control means for opening and closing the external entrance door and the external exit door.

28. The apparatus as defined in claim 23, wherein the fluid connection means includes a valve control means for opening and closing the associated valve for each cooling station in the in-line series of cooling stations.

29. The apparatus as defined in claim 24, wherein the fluid connection means comprises, for each station in the in-line series of cooling stations, an associated fluid outlet for receiving the cooling fluid from outside the insulation product and from within the cooling station.

30. The apparatus as defined in claim 29, wherein:

the cooling fluid is released into the last cooling station by the associated valve for the last cooling station;

for each cooling station in the series of cooling stations except for the last cooling station, the associated valve receives the cooling fluid from the associated fluid outlet for the associated next cooling station, and for the first cooling station, the heated cooling fluid received into the associated fluid outlet is directed to the hot fluid receiving means.

31. The apparatus as defined in claim 23, wherein each valve has an associated fan for blowing cooling fluid through the valve.

32. The apparatus as defined in claim 31, wherein a speed of the fan is adjustable to control at least one of a cooling rate and a hot fluid exhaust temperature.

33. The apparatus as defined in claim 23, wherein each valve is adjustable to accommodate insulation product of different dimensions.

34. An apparatus for cooling an insulation product, the apparatus comprising:

(a) an in-line series of cooling stations for cooling the insulation product, the series of cooling stations having a first cooling station for receiving the insulation product into the in-line series of cooling stations and a last cooling station for discharging the cooled insulation product from the in-line series of cooling stations;

(i) each cooling station in the series of cooling stations except for the first cooling station having an associated previous cooling station, and (ii) each cooling station in the series of cooling stations except for the last cooling station having an associated next cooling station;

(b) transport means for moving the insulation product through each station in the series of cooling stations, the transport means being operable to, (i) for each cooling station in the series of cooling stations except for the first cooling station, to move the insulation product into the cooling station from the associated previous cooling station, and (ii) for each cooling station in the series of cooling stations except for the last cooling station, to move the insulation product from the cooling station to the associated next cooling station; and, (c) cooling fluid supply means for supplying cooling fluid to each station in the series of stations to cool the insulation product;

(d) station connection control means for connecting stations in the series of stations;

wherein the cooling fluid supply means comprises:

(A) fluid connection means for directing fluid through the series of cooling stations, the fluid connections means being operable to direct cooling fluid (i) into the last cooling station, and then (ii) from each cooling station, except for the first cooling station, into the associated previous cooling station, (iii) into each cooling station, except for the last cooling station, from the associated next cooling station, and finally (iv) from the first cooling station into a hot fluid receiving means; and wherein the hot fluid receiving means includes an incinerator for further heating the cooling fluid and for incinerating pollutants discharged from the insulation product during cooling.

35. The apparatus as defined in claim 34, wherein the station connection control means is operable to for each cooling station in the series of cooling stations except for the first cooling station, to connect the cooling station with the associated previous cooling station, and for each cooling station in the series of cooling stations except for the last cooling station, to connect the cooling station to the associated next cooling station.

36. The apparatus as defined in claim 35, wherein:

the in-line series of cooling stations comprises an external housing for containing each station in the in-line series of stations, and the transport means is operable to move the insulation product through each station in the in-line series of stations without removing the insulation product from the housing.

37. The apparatus as defined in claim 36, wherein:

each cooling station in the series of cooling stations having an associated previous cooling station is adjacent to the associated previous cooling station, each cooling station in the series of cooling stations having an associated next cooling station is adjacent to the associated next cooling station, and for each cooling station in the series of stations except for the last station, the station connection control means comprises an associated exit door for controllably separating the station from the associated next cooling station, and associated door control means for opening the associated exit door to connect the station with the associated next cooling station, and for closing the associated exit door to substantially seal the station from the associated next cooling station.

38. The apparatus as defined in claim 37, further comprising:

an external entrance door for the first cooling station, an external exit door for the last cooling station, and external door control means for opening and closing the external entrance door and the external exit door.

39. The apparatus as defined in claim 34, wherein the fluid connection means comprises an associated valve for each station in the in-line series of cooling stations for directing the cooling fluid at the insulation product within the cooling station.

40. The apparatus as defined in claim 39, wherein the fluid connection means includes a valve control means for opening and closing the associated valve for each cooling station in the in-line series of cooling stations.

41. The apparatus as defined in claim 39, wherein:

the insulation product is hollow and has two open ends;

each cooling station in the in-line series of cooling stations comprises a pair of sealing plates for sealing each open end of the insulation product; and, the associated valve for each cooling station in the in-line series of cooling stations is operable to direct cooling fluid into a hollow interior of the insulation product.

42. The apparatus as defined in claim 41, wherein the fluid connection means comprises, for each station in the in-line series of cooling stations, an associated fluid outlet for receiving the cooling fluid from outside the insulation product and from within the cooling station.

43. The apparatus as defined in claim 42, wherein:

the cooling fluid is released into the last cooling station by the associated valve for the last cooling station;

for each cooling station in the series of cooling stations except for the last cooling station, the associated valve receives the cooling fluid from the associated fluid outlet for the associated next cooling station, and for the first cooling station, the heated cooling fluid received into the associated fluid outlet is directed to the hot fluid receiving means.

44. The apparatus as defined in claim 39, wherein each valve has an associated fan for blowing cooling fluid through the valve.

45. The apparatus as defined in claim 44, wherein a speed of the fan is adjustable to control at least one of a cooling rate and a hot fluid exhaust temperature.

46. The apparatus as defined in claim 39, wherein each valve is adjustable to accommodate insulation product of different dimensions.

47. An apparatus for cooling an insulation product, the apparatus comprising:

(a) an in-line series of cooling stations for cooling the insulation product, the series of cooling stations having a first cooling station for receiving the insulation product into the in-line series of cooling stations and a last cooling station for discharging the cooled insulation product from the in-line series of cooling stations;

(i) each cooling station in the series of cooling stations except for the first cooling station having an associated previous cooling station, and (ii) each cooling station in the series of cooling stations except for the last cooling station having an associated next cooling station;

(b) transport means for moving the insulation product through each station in the series of cooling stations, the transport means being operable to, (i) for each cooling station in the series of cooling stations except for the first cooling station, to move the insulation product into the cooling station from the associated previous cooling station, and (ii) for each cooling station in the series of cooling stations except for the last cooling station, to move the insulation product from the cooling station to the associated next cooling station; and, (c) cooling fluid supply means for supplying cooling fluid to each station in the series of stations to cool the insulation product;

(d) station connection control means for connecting stations in the series of stations;

wherein the cooling fluid supply means comprises (A) fluid connection means for directing fluid through the series of cooling stations, the fluid connections means being operable to direct cooling fluid (i) into the last cooling station, and then (ii) from each cooling station, except for the first cooling station, into the associated previous cooling station, (iii) into each cooling station, except for the last cooling station, from the associated next cooling station, and finally (iv) from the first cooling station into a hot fluid receiving means;

wherein the fluid connection means comprises an associated valve for each station in the in-line series of cooling stations for directing the cooling fluid at the insulation product within the cooling station; and wherein each valve has an associated fan for blowing cooling fluid through the valve.

* * * * *